US009187846B2

(12) United States Patent
Lee et al.

(10) Patent No.: US 9,187,846 B2
(45) Date of Patent: Nov. 17, 2015

(54) MICROARRAY PACKAGE DEVICE AND METHOD OF MANUFACTURING THE SAME

(75) Inventors: Woochang Lee, Anyang-si (KR); Jeo-young Shim, Yongin-si (KR); Myo-yong Lee, Suwon-si (KR); Kak Namkoong, Seoul (KR); Won-seok Chung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 843 days.

(21) Appl. No.: 12/938,485

(22) Filed: Nov. 3, 2010

(65) Prior Publication Data

US 2011/0237460 A1 Sep. 29, 2011

(30) Foreign Application Priority Data

Mar. 23, 2010 (KR) ..... 10-2010-0025874

(51) Int. Cl.
*B01L 3/00* (2006.01)
*C40B 60/12* (2006.01)

(52) U.S. Cl.
CPC ..... *C40B 60/12* (2013.01); *B01L 3/508* (2013.01); *B01L 2200/025* (2013.01); *B01L 2300/0819* (2013.01)

(58) Field of Classification Search
None
See application file for complete search history.

(56) References Cited

U.S. PATENT DOCUMENTS

| | | | |
|---|---|---|---|
| 5,945,334 | A | 8/1999 | Besemer et al. |
| 6,140,044 | A | 10/2000 | Besemer et al. |
| 6,399,365 | B2 | 6/2002 | Besemer et al. |
| 6,733,977 | B2 | 5/2004 | Besemer et al. |
| 6,743,632 | B2 | 6/2004 | Clarke et al. |
| 7,175,980 | B2 | 2/2007 | Qiu et al. |
| 7,220,573 | B2 | 5/2007 | Shea et al. |
| 2002/0127565 | A1 | 9/2002 | Cunningham et al. |
| 2003/0113724 | A1 | 6/2003 | Schembri et al. |
| 2009/0036328 | A1 | 2/2009 | Lee et al. |

FOREIGN PATENT DOCUMENTS

| | | | |
|---|---|---|---|
| JP | 2008-039584 | A | 2/2008 |
| KR | 1020090013532 | A | 5/2009 |
| KR | 1020090113306 | A | 10/2009 |

*Primary Examiner* — Christopher M Gross
(74) *Attorney, Agent, or Firm* — Leydig, Voit & Mayer, Ltd.

(57) ABSTRACT

A microarray package device and a method of manufacturing the same. An effective microarray analyzing reaction is performed by using the microarray package device that provides structural stability and reliable experimental results.

10 Claims, 5 Drawing Sheets

MICROARRAY PACKAGE DEVICE AND METHOD OF MANUFACTURING THE SAME

CROSS-REFERENCE TO RELATED APPLICATION

This application claims priority to Korean Patent Application No. 10-2010-0025874, filed on Mar. 23, 2010, and all the benefits accruing therefrom under 35 U.S.C. §119, the content of which in its entirety is herein incorporated by reference.

BACKGROUND

1. Field

The present disclosure relates to microarray package devices and methods of manufacturing the same.

2. Description of the Related Art

A method of analyzing a target biomaterial using a microarray has been used in various fields, for example, in studying functions of human genes, genetic analysis for diagnosing various diseases including cancer, and pharmacogenomics. A microarray is a device which includes biomaterial probes that are capable of being complementarily coupled, e.g., hybridized, to a target biomaterial, and plays a significant role in detecting and analyzing the target biomaterials. A microarray package device has been suggested for effectively analyzing a reaction of a microarray. In order to effectively perform an analysis process on a microarray, it is beneficial to ensure the structural stability of the microarray and the reliability of results obtained therefrom. Generally, a microarray is fixed in a microarray package, and a microarray analysis process is performed using an analyzing device such as an optical scanner. Thus, research has been conducted into use of a microarray package that provides structural stability for the microarray and increases a reliability of results obtained therefrom.

SUMMARY

Provided are microarray package devices that may provide structural stability and reliable experimental results.

Provided are methods of manufacturing microarray package devices that may provide structural stability and reliable experimental results.

Additional aspects will be set forth in part in the description which follows and, in part, will be apparent from the description, or may be learned by practice of the presented embodiments.

According to an embodiment of the present disclosure, a microarray package device includes; a microarray substrate including a front surface on which a biomaterial probe is disposed, a package substrate comprising a microarray accommodation unit, wherein the microarray accommodation unit comprises a bottom, at least one concave portion disposed in the bottom, and a sidewall connected to the bottom, wherein when a bottom surface of the microarray substrate is attached to the bottom, the bottom surface of the microarray substrate is aligned with the at least one concave portion, and the sidewall faces a side surface of the microarray substrate, and an adhesive disposed in a space between the bottom surface of the microarray substrate and the bottom of the microarray accommodation unit which adheres the microarray substrate and the package substrate to each other, wherein the adhesive fills and covers the at least one concave portion.

In one embodiment, the microarray package device may include a microarray substrate on which a biomaterial probe is disposed.

In one embodiment, the microarray package device is manufactured so that a microarray substrate is fixed to an external structure thereof, for example, a package substrate, and analysis of the microarray substrate is performed using a microarray analyzing device. Thus, the microarray package device may be installed to the microarray analyzing device, or alternatively, a sample including a target material may be introduced and analyzed by the microarray analyzing device, in order to perform analysis using the microarray substrate. In one embodiment, the microarray analyzing device may be, for example, a hybridization station. In one embodiment, the analysis of the target material may be performed by dying the target with a fluorescent material and analyzing the target material using an optical scanner.

In one embodiment, the microarray substrate includes a biomaterial probe that is fixed thereto and is capable of being coupled to a target material. For example, the biomaterial probe may be disposed on a front surface of the microarray substrate. The target material includes any biomaterial to be detected. Examples of the biomaterial include nucleic acids, proteins, sugars, viruses, cells, cell organelles and other similar materials. The nucleic acids may be DNA, RNA, PNA, oligonucleotides or other similar materials. The biomaterial may be derived from living organisms, or synthesized or semi-synthesized. The biomaterial may include at least one biomaterial monomer. Examples of the biomaterial may include DNA, RNA, nucleotide, nucleoside, protein, polypeptide, peptide, amino acid, carbohydrate, enzyme, an antibody, an antigen, a receptor, virus, stroma, ligand, membrane, and combinations thereof, but are not limited thereto. The microarray substrate may be used in various reactions such as a biological or biochemical reaction. For example, in an embodiment wherein a target nucleic acid is detected, the reaction may include providing a microarray substrate to which a nucleic acid probe having a complementary sequence to a known target nucleic acid is fixed, introducing a sample including a target nucleic acid labeled with a label (e.g., a fluorescent material) that is detected by the microarray substrate, and performing hybridization of the nucleic acid probe and the target nucleic acid. The reaction may include performing washing after the hybridization and removing a material not affected by the hybridization, and irradiating excited light to the fluorescent material of the hybridized result to detect fluorescent light emitted from the fluorescent material by using a microarray scan system. The microarray substrate may include a material, for example, quartz, silicon, glass, metal, plastic, ceramic or other material with similar characteristics, for coupling the biomaterial probe thereto, that is, a material that is capable of being coupled to the target material. For example, in one embodiment, the microarray substrate may be formed of silicon, quartz or glass. In addition, when the microarray substrate is formed of silicon, the microarray substrate may be processed to form an oxide layer ($SiO_2$) thereon. A surface of the microarray substrate may be processed with various materials in order to couple the biomaterial probe and the oxide layer to each other. For example, the processed material may include a material selected from the group consisting of various kinds of linkers, an amine group, a carboxyl group, an epoxy group, a sulfur group, an aldehyde group, activated ester, and maleimide. In one embodiment, the microarray substrate may have a flat, bead, or spherical shape, but is not limited thereto. For example, in one embodiment the microarray substrate may have a flat shape. In addition, the microarray substrate includes a predetermined region where the biomaterial probe is disposed. The region may be variously determined according to the use and type of the microarray.

In one embodiment, the microarray package device may include a package substrate comprising a microarray accommodation unit comprising a bottom and a sidewall, wherein a bottom surface of the microarray substrate is attached to the bottom, at least one concave portion is disposed on the bottom in a region corresponding to an attached lower portion of the microarray substrate, and the sidewall is connected to the bottom and faces a side surface of the microarray substrate.

In one embodiment, the package substrate may be formed of a material, for example, plastic, that is capable of being coupled to a bottom surface of the microarray substrate, but is not limited thereto. The package substrate may be formed to be flush with the microarray substrate. Generally, since the microarray package device is used with a fluorescent image detection system using an optical scanner, a portion of the package substrate for fixing the microarray substrate may be flush with the microarray substrate because, when a package substrate having a bottom including a protrusion is used, a surface of the microarray or a lens of the optical scanner may be damaged during the analysis of the optical scanner.

In one embodiment, the package substrate includes a microarray accommodation unit to which the microarray substrate is fixed. The microarray accommodation unit may have a space to which the microarray substrate is fixed. The space may have a length, area, or volume that varies with a type of the microarray substrate. The microarray accommodation unit includes a bottom and a sidewall that define a space to which the microarray substrate is fixed.

In one embodiment, the bottom is a portion to which a bottom surface of the microarray substrate is attached. The bottom may include an opening formed through the package substrate. The opening may define a fixation point for fixing the microarray substrate on the bottom surface of the microarray substrate during measurements, e.g., focusing and leveling, which are performed by the microarray analyzing device. Thus, compared to a package substrate having no opening, the package substrate having the opening may reduce an area of the microarray substrate when the two package substrates have the same biomaterial probe region. In addition, when the two package substrates have the same area as the microarray substrate, the integrity of the biomaterial probe may be increased.

In one embodiment, the bottom may include at least one concave portion disposed in a region to which the bottom surface is attached. A cross section of the concave portion may have a triangular shape, rectangular shape, semicircular shape, elliptical shape or other similar shape. At least two concave portions may be used. By disposing the concave portion on the bottom, a surface area of the bottom is greater than a surface area of the bottom surface. Therefore, when adhesives are disposed in a space between the bottom surface of the microarray substrate and the bottom of the microarray accommodation unit in order to adhere the microarray substrate and the package substrate to each other, the adhesives fill and cover the concave portion.

In one embodiment, the sidewall is connected to the bottom, and faces a side surface of the microarray substrate. A height of the sidewall may vary, but in one embodiment may be substantially equal to a height of the microarray substrate. Generally, since the microarray package device is used with a fluorescent image detection system using an optical scanner, the microarray package device including the microarray substrate may be compatible with the optical scanner in terms of the field of view and depth of focus. When the microarray package device deviates from a photographing region, or is inclined in a vertical direction, or when the microarray substrate is deformed due to physical external stress, an obtained image may be incorrect, e.g., warped or obfuscated, thus, a reliable analysis result may not be obtained. In order to prevent the deviation from an image acquisition region of the optical scanner, the microarray substrate may be fixed to the bottom and side wall. When the microarray substrate is fixed to the microarray accommodation unit, the microarray substrate is fixed to the bottom and the sidewall, a location of the microarray substrate may not deviate from the a permissible range of an image acquisition region of the optical scanner.

In one embodiment, the sidewall may include at least one protrusion that protrudes towards a side surface of the microarray substrate. In one embodiment, the protrusion may protrude from the sidewall to the side surface of the microarray substrate. In another embodiment, the protrusion may extend from the bottom. Thus, the side surface of the microarray substrate may be fixed to the microarray accommodation unit by the protrusion, and a portion of the sidewall which excludes the protrusion maintains a predetermined distance from the side surface of the microarray substrate. Thus, a space is formed between the sidewall and the side surface of the microarray substrate.

In one embodiment, the microarray package device may include an adhesive disposed in a space between the bottom surface of the microarray substrate and the bottom of the microarray accommodation unit so that the microarray substrate and the package substrate are adhered to each other, wherein the adhesives fill and cover the concave portion. In one embodiment, the adhesive may be an ultraviolet (UV) curable adhesive.

When the microarray substrate and the package substrate are adhered to each other by the adhesive, the adhesive may contract at an adhesion surface between the bottom surface of the microarray substrate and the bottom of the microarray accommodation unit since the adhesive are hardened, thereby causing deformation of the microarray substrate and/or the package substrate. When the microarray substrate formed of silicon and the package substrate formed of plastic are adhered to each other by the UV curable adhesives, the adhesive may contract due to the hardening of the adhesive, and thus a volume of the adhesive may be reduced, thereby causing deformation of the microarray substrate and/or the package substrate. Due to the deformation, flatness of the microarray package device may deteriorate, and thus it may be difficult to obtain reliable analyzing results of the optical scanner. However, in the embodiment of a microarray package device according to the present disclosure, the adhesive is disposed in the space between the bottom surface of the microarray substrate and the bottom of the microarray accommodation unit, and fills and covers the concave portion, thereby reducing the contraction of the adhesive and the deformation of the microarray substrate and/or the package substrate due to the hardening of the adhesive. When the adhesive fills and covers the concave portion, the adhesive contacts a greater area of the bottom of the package substrate than that of the bottom surface of the microarray substrate. Thus, a contraction of the adhesive due to the hardening thereof may be reduced, thereby reducing the deformation of the microarray substrate and/or the package substrate.

In one embodiment, when the microarray substrate and the package substrate are adhered to each other by the adhesive, since the adhesive is disposed between the adhesion surface between the bottom surface of the microarray substrate and the bottom of the microarray accommodation unit in a fluid state, the adhesive may be distributed in a narrow space between the side surface of the microarray substrate and the sidewall of the package substrate according to a capillary phenomenon. Thus, the adhesive may contract due to the hardening thereof between the side surface of the microarray substrate and the sidewall of the package substrate, and deformation of the microarray substrate and/or the package substrate may be caused. Due to the deformation, flatness of the microarray package device may deteriorate, and thus it may be difficult to obtain reliable analyzing result of the optical scanner. However, in another embodiment of a microarray package device according to the present disclosure, since at least one protrusion protruding towards the side surface of the microarray substrate is disposed on the sidewall of the microarray accommodation unit, the microarray substrate is fixed by the protrusion and does not deviate from a permission range of an image acquisition region of the optical scanner. In addition, since the space between the sidewall, excluding the protrusion, and the side surface of the microarray substrate and the sidewall is sufficiently wide, the distribution of the adhesives due to a capillary phenomenon may not occur. Thus, the contraction of the adhesive due to the hardening of the adhesive may be reduced between the side surface of the microarray substrate and the sidewall, thereby reducing the deformation of the microarray substrate and/or the package substrate.

According to another embodiment of the present disclosure, a method of manufacturing a microarray package device includes providing a microarray substrate including a front surface on which a biomaterial probe is disposed, providing a package substrate comprising a microarray accommodation unit comprising; a bottom corresponding to a bottom surface of the microarray substrate and comprising at least one concave portion disposed in a region to which a bottom surface is attached, and a sidewall connected to the bottom and corresponding to a side surface of the microarray substrate, and adhering the microarray substrate and the package substrate to each other with an adhesive which fills and covers the at least one concave portion.

In one embodiment, the method may include providing a microarray substrate on which a biomaterial probe is disposed to a front surface of the microarray substrate.

In one embodiment, the microarray package device is manufactured so that a microarray substrate is fixed to an external structure thereof, for example, a package substrate, and analysis is performed by a microarray analyzing device. Thus, the microarray package device may be installed to the microarray analyzing device, or alternatively, a sample including a target material is introduced, and is analyzed by the microarray analyzing device, in order to perform analysis using the microarray substrate. In one embodiment, the microarray analyzing device may be, for example, a hybridization station. In one embodiment, the analysis of the target material may be performed by dying the target with a fluorescent material and analyzing the target material by using an optical scanner.

In one embodiment, the microarray substrate includes a biomaterial probe that is fixed thereto and is capable of being coupled to a target material. For example, in one embodiment, the biomaterial probe may be disposed on a front surface of the microarray substrate. The target material includes any biomaterial to be detected. Examples of the biomaterial include nucleic acids, proteins, sugars, viruses, cells, and cell organelles and other similar materials as discussed above. The nucleic acids may be DNA, RNA, PNA, oligonucleotide and other similar materials as discussed above. The biomaterial may be derived from living organisms, or synthesized or semi-synthesized. The biomaterial may include at last one biomaterial monomer. Examples of the biomaterial may include DNA, RNA, nucleotide, nucleoside, protein, polypeptide, peptide, amino acid, carbohydrate, enzyme, an antibody, an antigen, a receptor, virus, stroma, ligand, membrane, and combinations thereof, but are not limited thereto. The microarray substrate may be used in various reactions such as a biological or biochemical reaction.

In one embodiment, the method may include providing a package substrate comprising a microarray accommodation unit comprising a bottom corresponding to a bottom surface of the microarray substrate and comprising at least one concave portion disposed in a region to which a bottom surface is attached, and a sidewall connected to the bottom and corresponding to a side surface of the microarray substrate.

In one embodiment, the package substrate may be formed of a material, for example, plastic, that is capable of being coupled to a bottom surface of the microarray substrate, but is not limited thereto. The package substrate may be flush with the microarray substrate. Generally, since the microarray package device is used with a fluorescent image detection system using an optical scanner, a portion of the package substrate for fixing the microarray substrate may be flush with the microarray substrate because, when a package substrate having a bottom including a protrusion is used, a surface of the microarray or a lens of the optical scanner may be damaged during the analysis of the optical scanner.

In one embodiment, the package substrate includes a microarray accommodation unit to which the microarray substrate is fixed. In one embodiment, the microarray accommodation unit may have a space to which the microarray substrate is fixed. In one embodiment, the space may have a length, area or volume that varies with a type of the microarray substrate. In one embodiment, the microarray accommodation unit includes a bottom and a sidewall that constitute a space to which the microarray substrate is fixed.

In one embodiment, the bottom is a portion to which a bottom surface of the microarray substrate is attached. The bottom may include an opening formed through the package substrate. The backside of the microarray substrate exposed by the opening may provide a fixation point for mounting the microarray substrate onto a microarray analyzing device for the measurement of focusing and leveling. While a package substrate without opening uses additional points for focusing and leveling on the front-side of microarray substrate, the package substrate with the opening may have those points created on the backside surface of the microarray substrate. Thus, the package substrate with the opening may reduce an area of the microarray substrate when the two package substrates have the same biomaterial probe region. In addition, when the two package substrates have the same area as the microarray substrate, the integration of the biomaterial probe per unit area may be increased.

In one embodiment, the bottom may include at least one concave portion disposed in a region to which the bottom surface is attached. A cross section of the concave portion may have a triangular, rectangular, semicircular or elliptical shape as discussed above. In another embodiment, at least two concave portions may be used. By disposing the concave portion on the bottom, a surface area of the bottom is greater than a surface area of the bottom surface. In this case, when adhesive is disposed in a space between the bottom surface of the microarray substrate and the bottom of the microarray accommodation unit in order to adhere the microarray substrate and the package substrate to each other, the adhesive fills and covers the concave portion.

In one embodiment, the sidewall is connected to the bottom, and faces a side surface of the microarray substrate. A height of the sidewall may vary, but may be substantially equal to a height of the microarray substrate. Generally, since the microarray package device is based on a fluorescent image detection system using an optical scanner, the microarray package device including the microarray substrate may be compatible with the optical scanner in terms of the field of view and depth of focus. When the microarray package device deviates from a photographing region, or is severely inclined in a height direction, or when the microarray substrate is deformed due to physical external stress, an image obtained therefrom may be incorrect, thus, a reliable analysis result may not be obtained. In order to prevent the deviation of microarray substrate from an allowable range of an image acquisition region of the optical scanner, the microarray substrate may be fixed to the bottom and side wall. When the microarray substrate is fixed to the microarray accommodation unit, the microarray substrate is fixed to the bottom and the sidewall, a location of the microarray substrate may not deviate from the permissible range of an image acquisition region of the optical scanner.

In one embodiment, the sidewall may include at least one protrusion that protrudes towards a side surface of the microarray substrate. In one embodiment, the protrusion may protrude from the sidewall to the side surface of the microarray substrate. In an alternative embodiment, the protrusion may extend from the bottom. Thus, the side surface of the microarray substrate may be fixed to the microarray accommodation unit by the protrusion, and a portion of the sidewall except for the protrusion maintains a predetermined distance from the side surface of the microarray substrate. Thus, a space is formed between the sidewall and the microarray substrate.

In one embodiment, the method may include adhering the microarray substrate and the package substrate to each other by forming a space between the bottom surface of the microarray substrate and the bottom of the microarray accommodation unit so as to fill and cover the concave portion.

In one embodiment, the adhesives may be a UV curable adhesive. When the microarray substrate and the package substrate are adhered to each other by the adhesive, the adhesive may contract at an adhesion surface between the bottom surface of the microarray substrate and the bottom of the microarray accommodation unit since the adhesive is hardened, thereby causing deformation of the microarray substrate and/or the package substrate. When the microarray substrate formed of silicon and the package substrate formed of plastic are adhered to each other by the UV curable adhesive, the adhesive may contract due to the hardening thereof, and thus a volume of the adhesive may be reduced, thereby causing deformation of the microarray substrate and/or the package substrate. Due to the deformation, flatness of the microarray package device may be deteriorated, and thus it may be difficult to obtain reliable analyzing results from the optical scanner. However, in the microarray package device according to an embodiment of the present disclosure, the adhesive is disposed in the space between the bottom surface of the microarray substrate and the bottom of the microarray accommodation unit, and fills and covers the concave portion, thereby reducing the contraction of the adhesive and the deformation of the microarray substrate and/or the package substrate due to the hardening of the adhesive. When the adhesive fills and covers the concave portion, the adhesive contacts a greater area of the bottom of the package substrate than that of the bottom surface of the microarray substrate. Thus, contraction due to the hardening of the adhesive may be reduced, thereby reducing the deformation of the microarray substrate and/or the package substrate.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
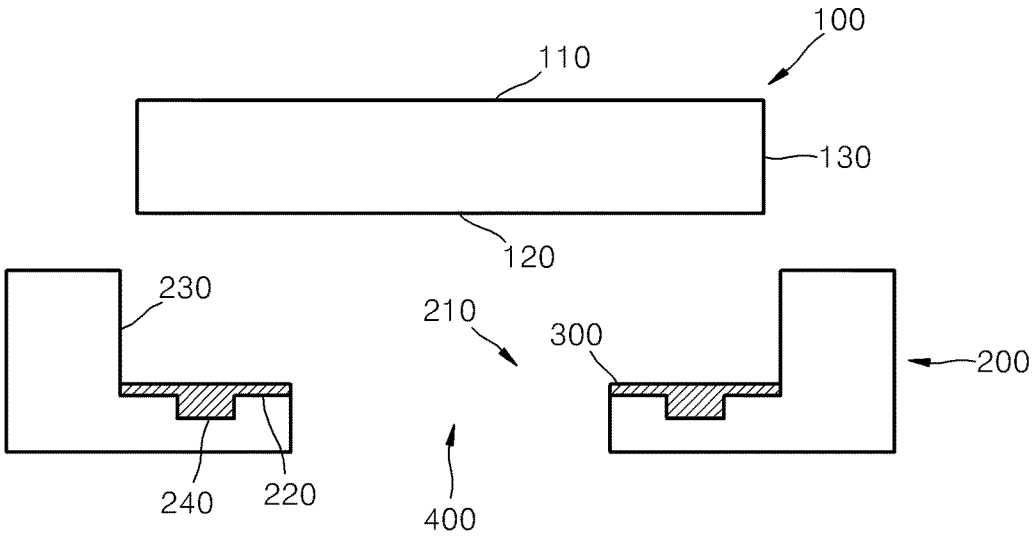
FIG. 1 is a cross-sectional view of an embodiment of a microarray package device prior to assembling a microarray substrate and a package substrate, according to the present disclosure[73]

Embodiments now will be described more fully hereinafter with reference to the accompanying drawings, in which embodiments are shown. These embodiments may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the disclosure.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope thereof unless otherwise claimed. No language in the specification should be construed as indicating any non-claimed element as essential to the practice of the embodiments as used herein.

Hereinafter, the embodiments will be described in detail with reference to the accompanying drawings.

Figure 2:
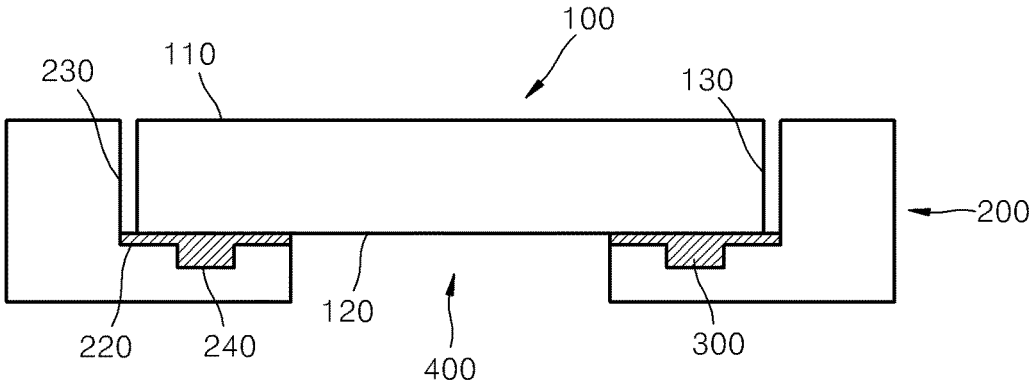
FIG. 2 is a cross-sectional view of the embodiment of a microarray package device of FIG. 1 after assembling the microarray substrate and the package substrate.

FIG. 1 is a cross-sectional view of an embodiment of a microarray package device before assembling a microarray substrate 100 and a package substrate 200, according to the present disclosure. FIG. 2 is a cross-sectional view of the embodiment of a microarray package device of FIG. 1 where the microarray substrate 100 and the package substrate 200 are assembled.

The microarray package device is used for analyzing a material via a microarray analyzing device (not shown), and the microarray substrate 100 is fixed to the package substrate 200. The microarray package device may be installed to a microarray analyzing device (not shown). A material, e.g., a solution, including a target material, e.g., a biomolecule to be detected, may be introduced to the microarray substrate 100, and then analyzed by the microarray analyzing device. In one embodiment, the microarray analyzing device may include, for example, an optical scanner, although alternative embodiments include alternative configurations using alternative devices.

A biomaterial probe (not shown) is disposed on a front surface 110 of the microarray substrate 100. The target material may include any biomaterial to be detected, although the target material is not limited to biomaterial. In one embodiment, the biomaterial probe may include at least one biomaterial monomer. The microarray substrate 100 may be used in various reactions such as a biological or biochemical reaction. The microarray substrate 100 may be formed of a material, for example, quartz, silicon, glass, metal, plastic, ceramic, or other materials with similar characteristics, for coupling the biomaterial probe thereto, wherein the biomaterial probe is capable of being coupled to the target material. For example, in one embodiment the microarray substrate 100 may be formed of silicon, quartz or glass. Embodiments of the microarray substrate 100 may have a flat, bead, or spherical shape, but the disclosure is not limited thereto. For example, in one embodiment the microarray substrate 100 may have a flat shape. In addition, the microarray substrate 100 may include a predetermined region where the biomaterial probe is disposed. The region may be determined according to the use and kind of microarray substrate 100.

The package substrate 200 may be formed of a material, for example, plastic, that is capable of being coupled to a bottom surface 120 of the microarray substrate 100. In the present embodiment, the package substrate 200 is flush with the microarray substrate 100. The package substrate 200 includes a microarray accommodation unit 210 to which the microarray substrate 100 is fixed. The microarray accommodation unit 210 may have a length, area or volume that varies according to a predetermined length, area or volume of the microarray substrate 100. The microarray accommodation unit 210 may include a bottom 220 and a sidewall 230 that constitute, i.e., define, a space in which the microarray substrate 100 is fixed.

The bottom 220 is a portion to which the bottom surface 120 of the microarray substrate 100 is attached. The bottom 220 may include an opening 400 formed through the package substrate 200. The opening 400 may define a fixing point for fixing the microarray substrate 100 on the bottom surface 120 of the microarray substrate 100 during measurements of focusing and leveling, which are performed by the microarray analyzing device.

At least one concave portion 240 is disposed on the bottom 220. Referring to FIGS. 1 and 2, a cross section of the concave portion 240 may have a rectangular shape, a triangular shape, a semicircular shape, an elliptical shape or various other similar shapes. By disposing the concave portion 240 on the bottom 220, a surface area of the bottom 220 is greater than a surface area of the bottom surface 120 of the microarray substrate 100, within an area including the attached bottom surface 120 of the microarray substrate 100. That is, in the region where the bottom 220 and the microarray substrate 100 are aligned, the bottom 220 has a larger surface area. In this case, when adhesives 300 are disposed in a space between the bottom surface 120 of the microarray substrate 100 and the bottom 220 of the microarray accommodation unit 210 in order to adhere the microarray substrate 100 and the package substrate 200 to each other, the adhesives 300 fill and cover the concave portion 240.

The sidewall 230 is connected to the bottom 220 of the microarray accommodation unit, and faces a side surface 130 of the microarray substrate 100. Referring to FIGS. 1 and 2, in the presented embodiment, a height of the sidewall 230 may be substantially equal to a height of the microarray substrate 100, however, alternative embodiments may include alternative configurations. When the microarray substrate 100 is adhered to the microarray accommodation unit 210, the microarray substrate 100 is fixed to the bottom 220, and is simultaneously fixed by the sidewall 230, and thus a location of the microarray substrate 100 does not deviate from an allowable range of an image acquisition region of the optical scanner. In one embodiment, the sidewall 230 is directly adjacent to, and contacts, the side surface 130 of the microarray substrate 100. Embodiments include configurations wherein one or more of the sidewalls 230 on opposing sides of the microarray substrate 100 may contact the side surfaces 130 of the microarray substrate.

In order to adhere the microarray substrate 100 and the package substrate 200 to each other, the adhesives 300 are disposed in the space between the bottom surface 120 of the microarray substrate 100 and the bottom 220 of the microarray accommodation unit 210, and fill and cover the concave portion 240. In one embodiment, the adhesives 300 may be ultraviolet ("UV") curable adhesives.

When the microarray substrate 100 and the package substrate 200 are adhered to each other by the adhesives 300, the adhesives 300 may be contracted at an adhesion surface between the bottom surface 120 of the microarray substrate 100 and the bottom 220 of the microarray accommodation unit 210 since the adhesives 300 may shrink as they are hardened, e.g., during curing or drying, thereby causing deformation of the microarray substrate 100 and/or the package substrate 200. When the microarray substrate 100 formed of silicon and the package substrate 200 formed of plastic are adhered to each other by the UV curable adhesives 300, the adhesives 300 may be contracted due to the hardening of the adhesives 300, and thus a volume of the adhesives 300 may be reduced, thereby causing deformation of the microarray substrate 100 and/or the package substrate 200. Due to the deformation, flatness of the microarray package device may deteriorate, and thus it may be difficult to obtain reliable analysis results from the microarray analyzing device, e.g., the optical scanner.

However, in the microarray package device according to the present embodiment, the adhesives 300 are disposed in the space between the bottom surface 120 of the microarray substrate 100 and the bottom 220 of the microarray accommodation unit 210, and fill and cover the concave portion 240, thereby reducing the contraction of the adhesives 300 and the deformation of the microarray substrate 100 and/or the package substrate 200 due to the hardening of the adhesives 300. When the adhesives 300 fill and cover the concave portion 240, the adhesives 300 contact a greater area of the bottom 220 of the package substrate 200 than that of the bottom surface 120 of the microarray substrate 100. Thus, a distortion due to contraction caused by the hardening of the adhesives 300 may be reduced, thereby reducing the deformation of the microarray substrate 100 and/or the package substrate 200.

The microarray package device may be manufactured by providing the microarray substrate 100 on which the biomaterial probe is disposed on the front surface 110 of the microarray substrate 100; providing the package substrate 200 including the microarray accommodation unit 210 including the bottom 220 corresponding to the bottom surface 120 of the microarray substrate 100 and including at least one concave portion 240 disposed in a region to which the bottom surface 120 is attached, and the sidewall 230 connected to the bottom 220 and corresponding to the side surface 130 of the microarray substrate 100; and adhering the microarray substrate 100 and the package substrate 200 to each other by disposing adhesive 300 in the space between the bottom surface 120 of the microarray substrate 100 and the bottom 220 of the microarray accommodation unit 210 so as to fill and cover the concave portion 240.

Figure 3:
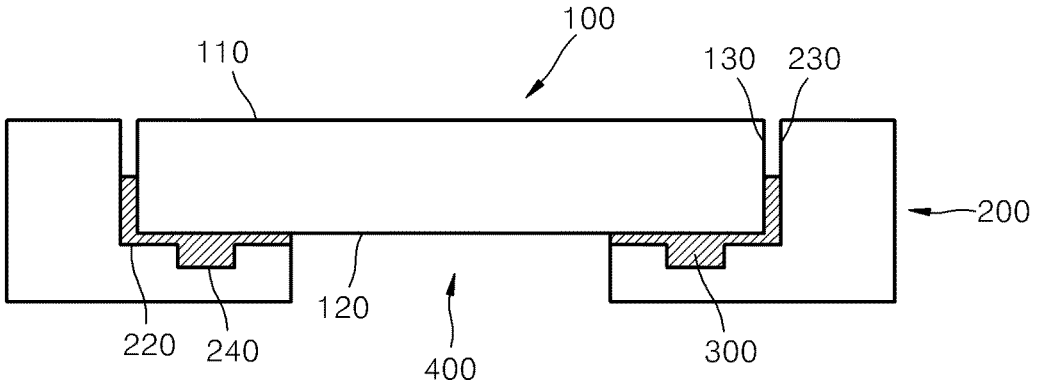
FIG. 3 is a cross-sectional view illustrating an embodiment where adhesives are distributed in a space between a side surface of the microarray substrate and a sidewall of the package substrate of the microarray package device, according to a capillary phenomenon.

FIG. 3 is a cross-sectional view illustrating an embodiment where the adhesives 300 are distributed in a space between the side surface 130 of the microarray substrate 100 and the sidewall 230 of the package substrate 200 of the microarray package device, according to a capillary phenomenon.

When the microarray substrate 100 and the package substrate 200 are adhered to each other by the adhesives 300, since the adhesives 300 disposed between the adhesion surface between the bottom surface 120 of the microarray substrate 100 and the bottom 220 of the microarray accommodation unit 210 are in a fluid state, the adhesives 300 may be distributed in a narrow space between the side surface 130 of the microarray substrate 100 and the sidewall 230 of the package substrate 200 according to a capillary phenomenon. Thus, the adhesives 300 may contract due to the hardening of the adhesives 300 between the side surface 130 of the microarray substrate 100 and the sidewall 230 of the package substrate 200, and the microarray substrate 100 and/or the package substrate 200 may be deformed. Thus, flatness of the microarray package device may deteriorate, and thus it may be difficult to obtain reliable analysis results from the microarray analyzing device, e.g., the optical scanner.

Figure 4:
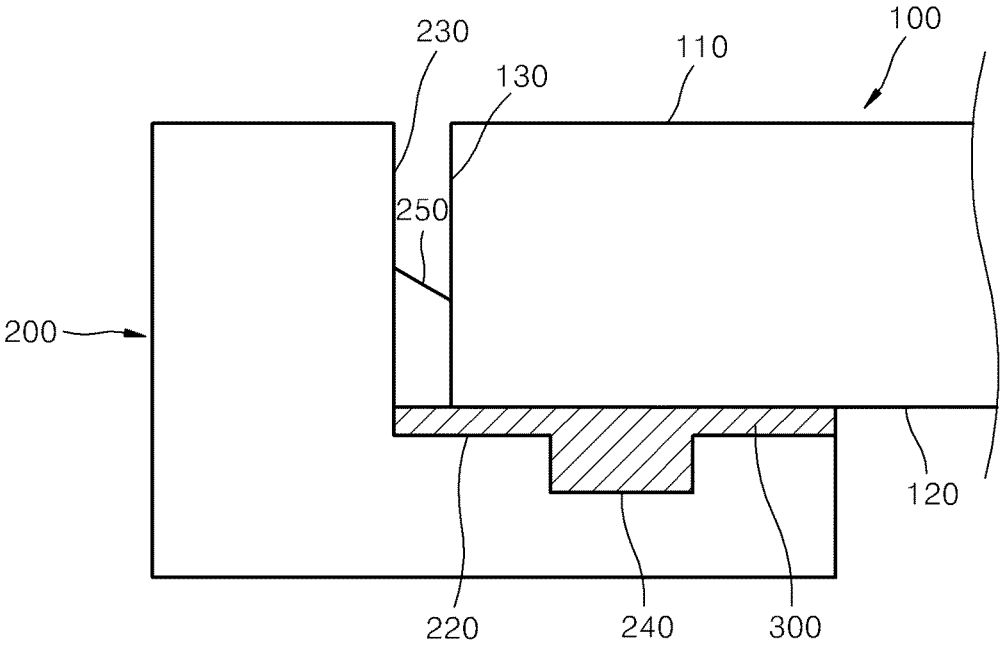
FIG. 4 is a cross-sectional view of another embodiment of a microarray package device including a sidewall including a protrusion, according to the present disclosure.

FIG. 4 is a cross-sectional view of another embodiment of a microarray package device including the sidewall 230 including a protrusion 250 which prevents distortion of the microarray substrate 100 or the package substrate 200 due to a capillary phenomenon according to the present disclosure.

The sidewall 230 includes at least one protrusion 250 that protrudes towards the side surface 130 of the microarray substrate 100. A shape of the protrusion 250 is not particularly limited. The protrusion 250 protrudes from the sidewall 230 to the side surface 130 of the microarray substrate 100. In addition, in another embodiment, the protrusion 250 may extend from the bottom 220. Thus, the side surface 130 of the microarray substrate 100 may be fixed to the microarray accommodation unit 210 by the protrusion 250, and a predetermined space may be formed between the sidewall 230 and the side surface 130 of the microarray substrate 100 except for a region corresponding to the protrusion 250.

In the microarray package device according to the present embodiment, since at least one protrusion 250 protruding towards the side surface 130 of the microarray substrate 100 is disposed on the sidewall 230 of the microarray accommodation unit 210, the microarray substrate 100 is fixed by the protrusion 250 and does not deviate from an allowable range of an image acquisition region of the optical scanner. That is, the protrusion 250 prevents lateral movement of the microarray substrate 100 from outside of a predetermined range. In addition, since the space between the sidewall 230 and the side surface 130 of the microarray substrate 100 in regions not corresponding to the protrusion 250 has a predetermined width, the distribution of the adhesives 300 due to a capillary phenomenon may be prevented. Thus, the contraction of the adhesives 300 due to the hardening of the adhesives 300 may be reduced between the side surface 130 of the microarray substrate 100 and the sidewall 230, thereby reducing the deformation of the microarray substrate 100 and/or the package substrate 200. Although the present embodiments have been illustrated such that the protrusion 250 is separate from the sidewall 230 of the package substrate 200, alternative embodiments include configurations wherein the protrusion 250 is formed as a single, solitary and indivisible component of the package substrate 200, e.g., the protrusion 250 and the package substrate 200 may be simultaneously formed via an injection molding process.

Figure 5A:
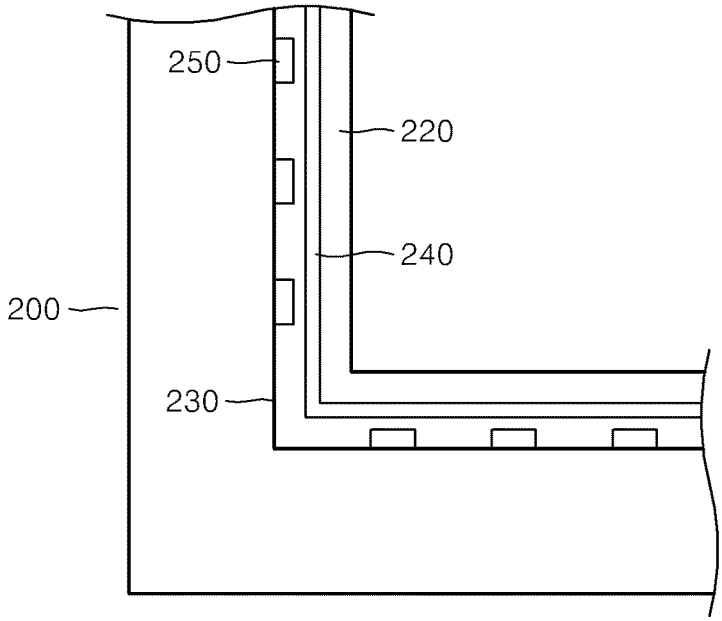
FIG. 5A is a top plan view of an embodiment of a package substrate, according to the present disclosure.
Figure 5B:
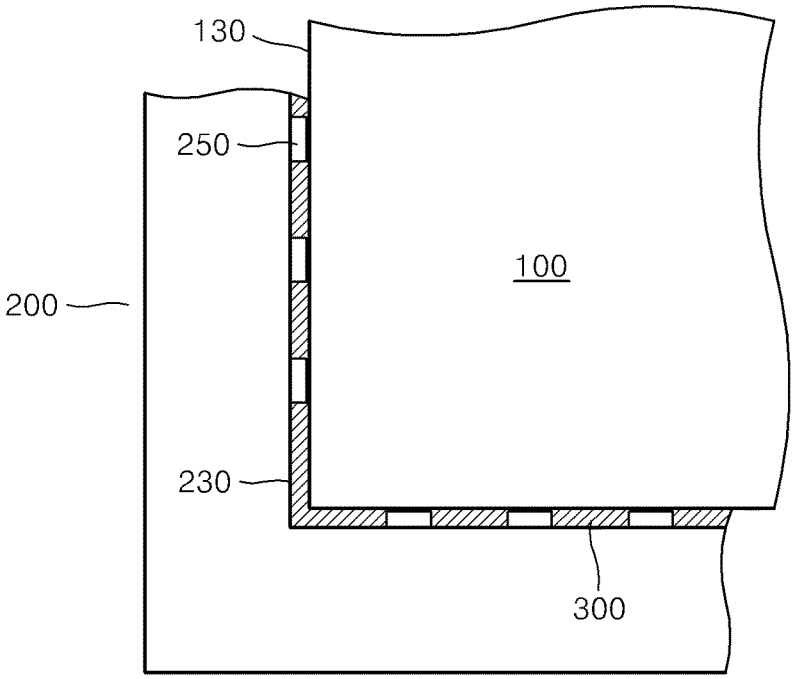
FIG. 5B is a top plan view of an embodiment where a microarray substrate is adhered to a package substrate by adhesives 300, according to the present disclosure.

FIG. 5A is a top plan view of the package substrate 200, according to an embodiment of the present disclosure. FIG. 5B is a top plan view of an embodiment where the microarray substrate 100 is adhered to the package substrate 200 by the adhesives 300, according to the present disclosure.

Referring to FIGS. 5A and 5B, the package substrate 200 includes the concave portion 240 disposed on the bottom 220 of the microarray accommodation unit 210 to which the microarray substrate 100 is fixed, and the protrusion 250 disposed on the sidewall 230 of the microarray accommodation unit 210. As illustrated in FIGS. 5A and 5B, the concave portion 240 is illustrated as being a continuous element and the protrusion 250 is illustrated as being discontinuous; however, alternative embodiments include configurations wherein either the concave portion 240 and the protrusion 250 are both continuous, both discontinuous, or a combination of both continuous and discontinuous. When the microarray substrate 100 is fixed to the microarray accommodation unit 210 of the package substrate 200 by the adhesives 300, the bottom surface 120 of the microarray substrate 100 is adhered to the bottom 220 including the concave portion 240, and the side surface 130 of the microarray substrate 100 is laterally fixed by the protrusion 250. Thus, the adhesives 300 are disposed in the space between the bottom surface 120 of the microarray substrate 100 and the bottom 220 of the microarray accommodation unit 210, and fill and cover the concave portion 240. In such an embodiment, the contraction of the adhesives 300 due to the hardening of the adhesives 300 may be reduced, and the deformation of the microarray substrate 100 and/or the package substrate 200 may be reduced. The microarray substrate 100 may be fixed by the protrusion 250, and thus the microarray substrate 100 may not deviate from an allowable range of an image acquisition region of the microarray analyzing device, e.g., an optical scanner. Since the space between the sidewall 230 except for the protrusion 250 and the side surface 130 of the microarray substrate 100 is sufficiently wide, the distribution of the adhesives 300 may not occur, and the contraction of the adhesives 300 due to the hardening of the adhesives 300 between the side surface 130 of the microarray substrate 100 and the sidewall 230 may be reduced, thereby reducing the stress for deformation exerted to the microarray substrate 100 and/or the package substrate 200.

FIGS. 6A through 6D are images showing measuring results from a microarray analyzing device using a microarray package device, wherein the measuring is performed by an optical scanner, according to an embodiment of the present disclosure.

A package substrate (96.0×30.0×3.0 mm3) formed of plastic, adhesives (such as a UV-adhesive, Loctite 3103, ~10,000 cP, from Henkel™), a microarray substrate (15.2×23.2×0.7 mm3) formed of silicon, and a solution for nucleic acid hybridization were prepared. Two types of package substrates were prepared. That is, the first type package substrate was formed as a comparative embodiment and did not include a concave portion disposed on a bottom surface of a microarray accommodation unit and a protrusion disposed on a sidewall of the microarray accommodation unit, and the second type package substrate was formed as an embodiment of the present disclosure and included the concave portion disposed on the bottom surface of the microarray accommodation unit and the protrusion disposed on the sidewall of the microarray accommodation unit (the remaining configurations of the package substrates were the same). The solution included a predetermined labeled target DNA, 12×SSPET (1.8M NaCl, Triton X-100 0.2%), distilled water, and 100% concentration of formamide. Predetermined amounts of adhesives were respectively coated on the bottom surfaces of the microarray accommodation units of the first and second package substrates using an adhesive ejector. Each surface to which the adhesives were coated was adhered to the bottom surface of the microarray substrate, and about 1 kg of weight was applied to the microarray substrate while a biomaterial probe region of the microarray substrate may not be contaminated, and thus the microarray substrate was adhered to the package substrate. Then, ultraviolet rays were irradiated to the adhesives to cause the hardening of the adhesives.

The solution was introduced to the microarray package devices using the first and second type package substrates, and nucleic acid hybridization was performed for about 4 hours at a temperature of about 50° C. After the nucleic acid hybridization was performed, the resultant devices were primarily washed using a 3×SSPET solution for about 5 minutes, and were secondarily washed using a 0.5×SSPET solution for about 5 minutes. Thus, DNA where the nucleic acid hybridization was not performed and a fluorescent labels were removed from front surfaces of microarray substrates. Then, the solution remaining on the front surfaces of the microarray substrates was removed by a centrifugal separator (1500 rpm, 1 minute), the results of the nucleic acid hybridization of the front surfaces of the microarray substrates were observed using a microarray optical scanner to obtain image data.

In order to determine a degree of deformation of the microarray substrates and the first and second type package substrates, image data regarding a portion (hereinafter, referred to as "panel number 10") that approximately corresponds to an edge of the surface of the microarray substrate, and a portion (hereinafter, referred to as "panel number 261") that approximately correspond to a center of the surface of the microarray substrate were acquired. That is, the region 10 is disposed near an edge of the microarray substrate and the region 261 is disposed near a center of the microarray substrate, as seen from a top plan view.

Figure 6A:
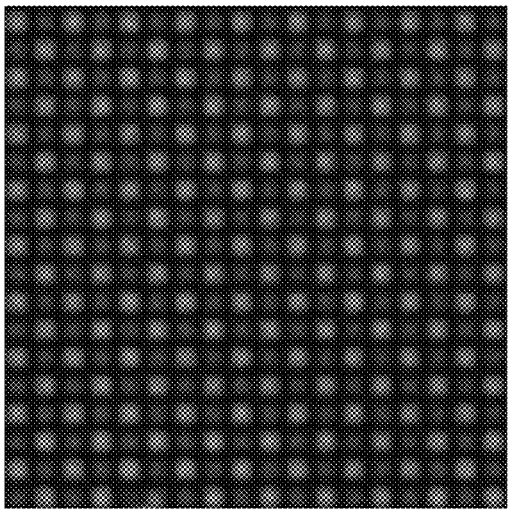
FIGS. 6A through 6D are images illustrating results of measuring analysis results of a microarray analyzing device using a microarray package device, wherein the measuring is performed by an optical scanner, according to an embodiment of the present disclosure.
Figure 6B:
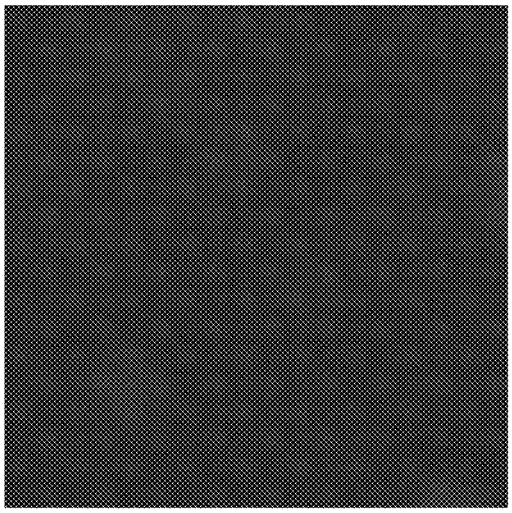
Figure 6C:
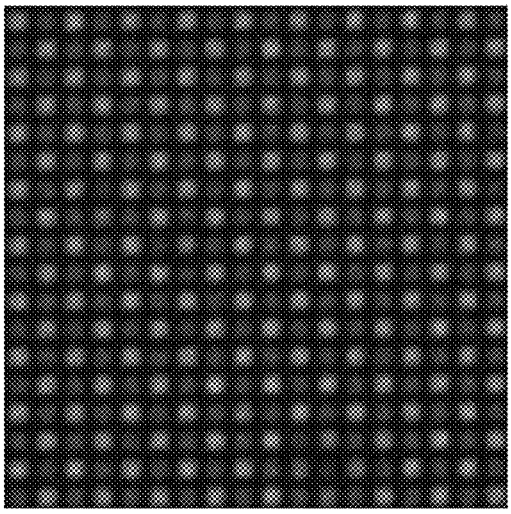
Figure 6D:
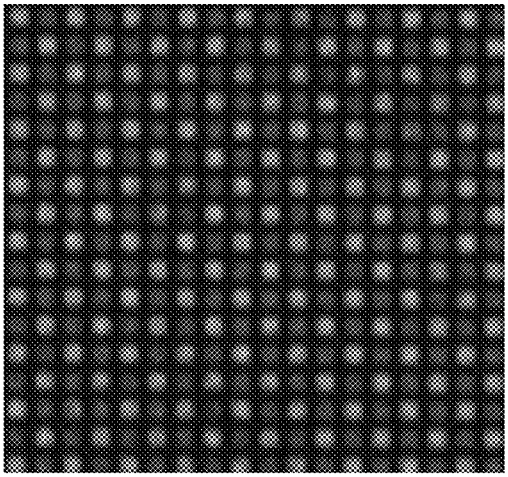

FIGS. 6A and 6B are fluorescence images of a microarray substrate using a microarray substrate including the first type package substrate after hybridization. FIGS. 6C and 6D are fluorescence images of a microarray substrate using a microarray substrate including the second type package substrate after hybridization, wherein the second type package is an embodiment of a package substrate according to the present disclosure. In addition, FIGS. 6A and 6C show the image data regarding the edge of the microarray substrate (panel number 10), and FIGS. 6B and 6D show the image data regarding the center of the microarray substrate (panel number 261). As a result, when the image of the panel number 10 of FIG. 6A and the image of the panel number 261 of FIG. 6B are compared, the image of the panel number 261 of FIG. 6B was blurred. However, when the image of the panel number 10 of FIG. 6C and the image of the panel number 261 of FIG. 6D, the image of the panel number 261 of FIG. 6D had little or no blurring effects.

As described above, according to the one or more of the above embodiments of the present disclosure, the microarray package device may derive structurally stable and reliable experimental results, in an analyzing process of a microarray substrate.

In addition, as described above, a method of fabricating the microarray package device that may derive structurally stable and reliable experimental results, in an analyzing process of a microarray substrate is provided.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A microarray package device comprising:

a microarray substrate including a front surface on which a biomaterial probe is disposed;

a package substrate comprising a microarray accommodation unit, wherein the microarray accommodation unit comprises:

a bottom;

at least one concave portion disposed in the bottom; and a sidewall connected to the bottom, wherein, when a bottom surface of the microarray substrate is attached to the bottom of the microarray accommodation unit, the bottom surface of the microarray substrate is aligned with the at least one concave portion, and the sidewall of the microarray accommodation unit faces a side surface of the microarray substrate; and an adhesive disposed in a space between the bottom surface of the microarray substrate and the bottom of the microarray accommodation unit which adheres the microarray substrate and the package substrate to each other, wherein the adhesive fills and covers the at least one concave portion, and wherein the microarray accommodation unit further comprises at least one protrusion which protrudes longitudinally towards a side surface of the microarray substrate when a bottom surface of the microarray substrate is attached to the bottom of the microarray accommodation unit.

2. The microarray package device of claim 1, wherein the microarray substrate comprises at least one of silicon and glass.

3. The microarray package device of claim 1, wherein a cross section of the concave portion has at least one of a triangular, rectangular, semicircular and elliptical shape.

4. The microarray package device of claim 1, wherein the protrusion protrudes from the sidewall towards the side surface of the microarray substrate when a bottom surface of the microarray substrate is attached to the bottom of the microarray accommodation unit.

5. The microarray package device of claim 1, wherein the package substrate comprises plastic.

6. A method of manufacturing a microarray package device of claim 1, the method of comprising:

providing a microarray substrate including a front surface on which a biomaterial probe is disposed;

providing a package substrate comprising a microarray accommodation unit comprising:

a bottom;

at least one concave portion disposed in the bottom; and a sidewall connected to the bottom; and adhering the microarray substrate and the package substrate to each other with an adhesive which fills and covers the at least one concave portion.

7. The method of claim 6, wherein the microarray substrate comprises at least one of silicon and glass.

8. The method of claim 6, wherein a cross section of the concave portion has at least one of a triangular, rectangular, semicircular, and elliptical shape.

9. The method of claim 6, wherein the protrusion protrudes from the sidewall to the side surface of the microarray substrate.

10. The method of claim 6, wherein the package substrate comprises plastic.

* * * * *